US007197152B2

(12) United States Patent
Miller et al.

(10) Patent No.: US 7,197,152 B2
(45) Date of Patent: Mar. 27, 2007

(54) FREQUENCY RESPONSE EQUALIZATION SYSTEM FOR HEARING AID MICROPHONES

(75) Inventors: Douglas Alan Miller, Lafayette, CO (US); Scott Allan Miller, III, Golden, CO (US)

(73) Assignee: Otologics LLC, Boulder, CO (US)

( * ) Notice: Subject to any disclaimer, the term of this patent is extended or adjusted under 35 U.S.C. 154(b) by 668 days.

(21) Appl. No.: 10/082,988

(22) Filed: Feb. 26, 2002

(65) Prior Publication Data

US 2003/0161492 A1 Aug. 28, 2003

(51) Int. Cl.
*H04R 25/00* (2006.01)

(52) U.S. Cl. ..... 381/326; 381/312; 381/318

(58) Field of Classification Search ..... 381/60, 381/312, 315–318, 320–321, 326; 600/25, 600/559; 607/55, 56, 57
See application file for complete search history.

(56) References Cited

U.S. PATENT DOCUMENTS

| | | | | |
|---|---|---|---|---|
| 3,902,084 A | | 8/1975 | May, Jr. | 310/8.1 |
| 3,902,085 A | | 8/1975 | Bizzigotti | 310/8.3 |
| 4,428,377 A | | 1/1984 | Zollner et al. | 128/419 |
| 4,441,210 A | | 4/1984 | Hochmair et al. | 455/41 |
| 4,944,301 A | | 7/1990 | Widin et al. | 128/420.6 |
| 4,947,844 A | | 8/1990 | McDermott | 128/421 |
| 5,024,224 A | | 6/1991 | Engebretson | 128/420.6 |
| 5,061,282 A | | 10/1991 | Jacobs | 623/10 |
| 5,069,210 A | | 12/1991 | Jeutter et al. | 128/420.6 |
| 5,259,033 A | * | 11/1993 | Goodings et al. | 381/318 |
| 5,282,858 A | | 2/1994 | Bisch et al. | 623/10 |
| 5,531,774 A | | 7/1996 | Schulman et al. | 607/56 |
| 5,553,152 A | | 9/1996 | Newton | 381/68.6 |
| 5,554,096 A | | 9/1996 | Ball | 600/25 |
| 5,569,307 A | | 10/1996 | Schulman et al. | 607/56 |
| 5,571,148 A | | 11/1996 | Loeb et al. | 607/57 |
| 5,603,726 A | | 2/1997 | Schulman et al. | 607/57 |
| 5,609,616 A | | 3/1997 | Schulman et al. | 607/56 |
| 5,624,376 A | | 4/1997 | Ball et al. | 600/25 |
| 5,702,342 A | | 12/1997 | Metzler et al. | 600/25 |
| 5,707,338 A | | 1/1998 | Adams et al. | 600/25 |
| 5,772,575 A | | 6/1998 | Lesinski et al. | 600/25 |
| 5,776,172 A | | 7/1998 | Schulman et al. | 607/56 |
| 5,842,967 A | | 12/1998 | Kroll | 600/25 |
| 5,857,958 A | | 1/1999 | Ball et al. | 600/25 |
| 5,876,425 A | | 3/1999 | Gord et al. | 607/56 |
| 5,879,283 A | | 3/1999 | Adams et al. | 600/25 |
| 5,899,847 A | | 5/1999 | Adams et al. | 600/25 |

(Continued)

*Primary Examiner*—Suhan Ni
(74) *Attorney, Agent, or Firm*—Marsh Fischmann & Breyfogle LLP

(57) ABSTRACT

A system and method to compensate for changes in the frequency response of a microphone caused by factors interfering with the receipt of acoustic sound in the microphone. The system includes at least a microphone and a signal processor. The signal processor is operational to process at least one feedback frequency response from the microphone to generate at least one test parameter. The signal processor uses the at least one test parameter to determine at least one operational characteristic of the microphone. The feedback frequency response is generated by the microphone in response to acoustic feedback. The acoustic feedback is generated by actuation of a transducer in response to at least one test signal that is provided to the transducer. The signal processor uses the at least one test parameter to process acoustic frequency responses from the microphone to compensate for changes in the acoustic frequency responses of the microphone.

33 Claims, 4 Drawing Sheets

U.S. PATENT DOCUMENTS

| | | | | |
|---|---|---|---|---|
| 5,938,691 | A | 8/1999 | Schulman et al. | 607/57 |
| 5,954,628 | A | 9/1999 | Kennedy | 600/25 |
| 5,991,663 | A | 11/1999 | Irlicht et al. | 607/57 |
| 5,993,376 | A | 11/1999 | Kennedy | 600/25 |
| 5,997,446 | A | 12/1999 | Stearns | 482/96 |
| 5,997,466 | A | 12/1999 | Adams et al. | 600/25 |
| 5,999,856 | A | 12/1999 | Kennedy | 607/57 |
| 6,001,129 | A | 12/1999 | Bushek et al. | 623/10 |
| 6,005,955 | A | 12/1999 | Kroll et al. | 381/328 |
| 6,554,762 | B2 * | 4/2003 | Leysieffer | 600/25 |

* cited by examiner

Equalization Matrix 300

| Session | $\Delta F1_1$ $\Delta F2_1$ • • • • $\Delta FNth_1$ |
|---|---|
| 1. | |
| 2. | $\Delta F1_2$ $\Delta F2_2$ • • • • $\Delta FNth_2$ |
| 3. | $\Delta F1_3$ $\Delta F2_3$ • • • • $\Delta FNth_3$ |
| • • • • | |
| Nth. | $\Delta F1_N \Delta F2_N$ • • • • $\Delta FNth_N$ |
| Freq. | 250Hz 500Hz • • • • Nth. |

FIG. 3

FREQUENCY RESPONSE EQUALIZATION SYSTEM FOR HEARING AID MICROPHONES

FIELD OF THE INVENTION

The invention is related to the field of microphones, and in particular to a method and system to compensate for changes in a microphone's frequency response caused by factors interfering with the receipt of acoustic sound in the microphone, and more particularly, to compensating for changes in a hearing aid microphone's frequency response.

BACKGROUND OF THE INVENTION

Hearing aids receive and process acoustic sound to stimulate components of the auditory system to cause the sensation of hearing in a patient. Hearing aids are generally categorized into one of two types, namely, externally worn types and implantable types. In addition, implantable hearing aids can be further categorized into fully implantable devices and semi-implantable, e.g. devices that include some implanted components (typically a signal processor and transducer) and some external components (typically a microphone and speech processor).

One type of implantable hearing aid utilizes a transducer having a vibratory member implanted within the middle ear cavity that mechanically stimulates the ossicular chain via axial vibrations. In one application of such a device, a microphone receives acoustic sound and generates frequency responses for a speech processor. The speech processor, in turn, processes the frequency responses according to internal values for the patient to generate a processed signal that drives the transducer to cause the mechanical stimulation and sensation of sound in the patient.

Unfortunately, over time the frequency responses generated by hearing aid microphones can change, thereby affecting the perception of sound to the patient. The changes in the frequency response can be caused by a number of factors. In semi-implantable and externally worn devices for example, dirt and other debris can collect on or around the microphone port affecting the microphone's frequency responses to acoustic signals. In hearing aids having implanted microphones, changes in the tissue surrounding the microphone can affect the microphones frequency response to acoustic signals. In this case, the changes e.g. thickness, density, and compliance in the tissue, typically occur gradually following the implant and directly affect the sound received in the microphone and thus the resulting frequency response generated by the microphone for the speech processor. The changes in the frequency response can result in either a decrease or increase in the perception of sound to the patient depending on the current state of the tissue. For example, when the microphone is initially implanted and tuned to the patient's hearing needs, the tissue is typically soft. Over time, however, the tissue thickens and a fibrous capsule is formed before a stabilized state is reached. As the tissue changes so does the patient's hearing function, requiring the patient to visit an audiologist for additional tuning of the hearing aid.

SUMMARY OF THE INVENTION

In view of the foregoing, a primary object of the present invention is to determine operational characteristics of hearing aid microphones. Another object of the present invention is to provide a hearing aid device that automatically compensates for changes in the frequency responses of hearing aid microphones. Yet, another object of the present invention is to periodically test the frequency response of hearing aid microphones and adjust or equalize the frequency responses to compensate for changes that occur.

In carrying out the above objects, and other objects, features, and advantages of the present invention, a first aspect is provided, which includes a hearing aid having a signal processor, a microphone, and implanted transducer. In a hearing aid according to the subject first aspect, the signal processor processes at least one feedback frequency response from the microphone to generate at least one test parameter. The signal processor uses the at least one test parameter to determine at least one operational characteristic of the microphone, e.g. changes in the frequency response of the microphone. The feedback frequency response is generated by the microphone in response to acoustic feedback in the hearing aid. The acoustic feedback is generated by actuation of the transducer in response to at least one test signal that is provided to the transducer. In this regard, a test signal generator that may be separate or included on the processor may provide the test signal. It should be noted that in the case where a separate signal generator is used, the test signal is provided to the transducer via the signal processor so that the signal processor has knowledge of the test signal characteristics. Further, in this regard, the processor/signal generator may periodically generate the test signal that produces the feedback in the hearing aid. The periodic generation of the test signal is hereinafter referred to as a test session.

The feedback is detectable by the microphone as an acoustic sound generated by and carried through one or more components of the auditory system, e.g. the tympanic membrane and ear canal, in response to stimulation of the auditory system by the transducer. The microphone, in turn, generates a frequency response to the feedback, referred to herein as a feedback frequency response. The signal processor receives this feedback frequency response from the microphone and uses this signal in combination with the original test signal characteristics to generate one or more test parameters. The one or more test parameters may be stored in an equalization matrix. The equalization matrix is used by the signal processor to adjust the frequency responses generated by the microphone in response to ambient acoustic inputs, to compensate for changes occurring in those frequency responses over time, e.g. changes caused by tissue growth around the microphone. As referred to herein, the term acoustic frequency responses refers to frequency responses of the microphone generated in response to ambient acoustic inputs as opposed to the acoustic feedback.

Various refinements exist of the features noted in relation to the subject first aspect of the present invention. Further features may also be incorporated in the subject first aspect of the present invention as well. These refinements and additional features may exist individually or in any combination. Thus, according to one feature, the test signal could be provided at a predetermined frequency to the transducer to generate the acoustic feedback at a predetermined tone. In another example, the test signal could be provided at a plurality of predetermined frequencies, e.g. swept across a frequency range, to the transducer to generate the acoustic feedback at a plurality of predetermined tones. Similarly, the test signal could be one of noise, pseudorandom noise, or a chirp(s).

In another feature the equalization matrix could include one or more delta frequencies. The delta frequencies could represent the difference between the feedback frequency response received in the signal processor and a calibration frequency response (e.g. a pre-determined frequency response stored in a memory device connected to the signal processor) at the same frequency. The calibration frequency response could be included in a calibration matrix that is generated prior to implanting the microphone and includes the microphone's frequency responses relative to a baseline, such as the microphone's frequency responses in a saline solution. The calibration frequency response could also be generated from the original characteristics, e.g. frequency and/or amplitude, of the test signal as provided by the signal processor. In this regard, the delta frequencies could represent differences between the test signal as provided and the test signal as received by the signal processor in the feedback frequency response.

In another feature of the subject first aspect, the signal processor could include logic to protect against abnormal conditions that may be present when a test signal is provided. For example, the signal processor may include an upper and lower threshold frequency response (e.g. upper and lower threshold values stored in a memory connected to the signal processor). In this regard, if the feedback frequency response is outside of the upper and lower threshold frequency response, the signal processor could continue to use a previous feedback frequency response and not generate new delta frequencies for the equalization matrix. If, however, the feedback frequency response is within the upper and lower threshold frequency response the signal processor uses the feedback frequency response to generate the delta frequencies for the equalization matrix. In this manner, abnormal conditions cannot skew the feedback frequency response and equalization matrix as the matrix is not updated if the feedback frequency response is not within the expected range.

In a second aspect of the invention, a method of compensating for changes in the frequency response of a subcutaneous microphone is provided. The method includes at least the steps of conducting a test session to determine changes in the frequency responses of the microphone, generating at least one test measure representative of the changes in the frequency response of the microphone, and using the test measure to compensate for the changes in the frequency response of the microphone. During the test session, a test signal is generated and provided by a signal generator that may or may not be included on a signal processor. As described above, the test signal is detectable by the microphone causing the microphone to generate a feedback frequency response that can be used by the signal processor to generate one or more test parameters for an equalization matrix. The signal processor then resumes normal operation, wherein it receives and processes acoustic frequency responses from the microphone using the equalization matrix to generate processed signals for the transducer that compensate for changes in the acoustic frequency responses.

Various refinements exist of the features noted in relation to the subject second aspect of the present invention. Further features may also be incorporated in the subject second aspect of the present invention as well. These refinements and additional features may exist individually or in any combination.

In a third aspect of the invention, a frequency equalization system is provided. The frequency equalization system includes at least a signal processor and a microphone that is capable of processing acoustic sounds to generate frequency responses representative of the acoustic sounds. The signal processor may include a test signal generator to generate and provide a test signal that is detectable by the microphone. The signal processor may also include equalization logic to process a feedback frequency response from the microphone representative of the test signal to generate an equalization matrix. Finally, the signal processor may include frequency shaping logic that uses the equalization matrix to process acoustic frequency responses to generate processed signals that compensate for changes in those frequency responses.

Various refinements exist of the features noted in relation to the subject third aspect of the present invention. Further features may also be incorporated in the subject third aspect of the present invention as well. These refinements and additional features may exist individually or in any combination.

In a fourth aspect of the present invention, a software product for the frequency equalization system is provided. The software product includes test signal generator instructions that are operational when executed on a processor to generate a test signal for a transducer at a predetermined frequency to produce a predetermined test tone. The software product further includes equalization logic instructions that are operational when executed on the processor to direct the processor to process a feedback frequency response representative of the at least one test tone to generate at least one test parameter. The software product includes frequency shaping logic instructions that are operational when executed on the processor to direct the processor to process acoustic frequency responses to generate drive signals for the transducer that compensate for changes in the acoustic frequency responses. Finally, a storage medium that is operational to store the test signal generator instructions, the equalization logic instructions, and frequency shaping logic instructions is provided.

Various refinements exist of the features noted in relation to the subject fourth aspect of the present invention. Further features may also be incorporated in the subject fourth aspect of the present invention as well. These refinements and additional features may exist individually or in any combination.

Numerous additional aspects and advantages of the present invention will become apparent to those skilled in the art upon consideration of the following figures and description.

BRIEF DESCRIPTION OF THE DRAWINGS

FIG. 3 is an example of an equalization matrix; and

DETAILED DESCRIPTION

Reference will now be made to the accompanying drawings, which at least assist in illustrating the various pertinent features of the present invention. Although the present invention will now be described in conjunction with a fully implanted hearing aid, it should be expressly understood that the present invention is not limited to this application, but rather, only to applications where a microphone or similar device is included. For example, it will be readily apparent to those skilled in the art that the principles of the present invention could easily be applied to other systems including implanted and external microphones, e.g. external or semi-implantable hearing aid devices and/or a microphone implanted in a patient's throat for purposes of speech, to compensate for dynamic characteristics of the microphone's frequency response.

Figure 1:
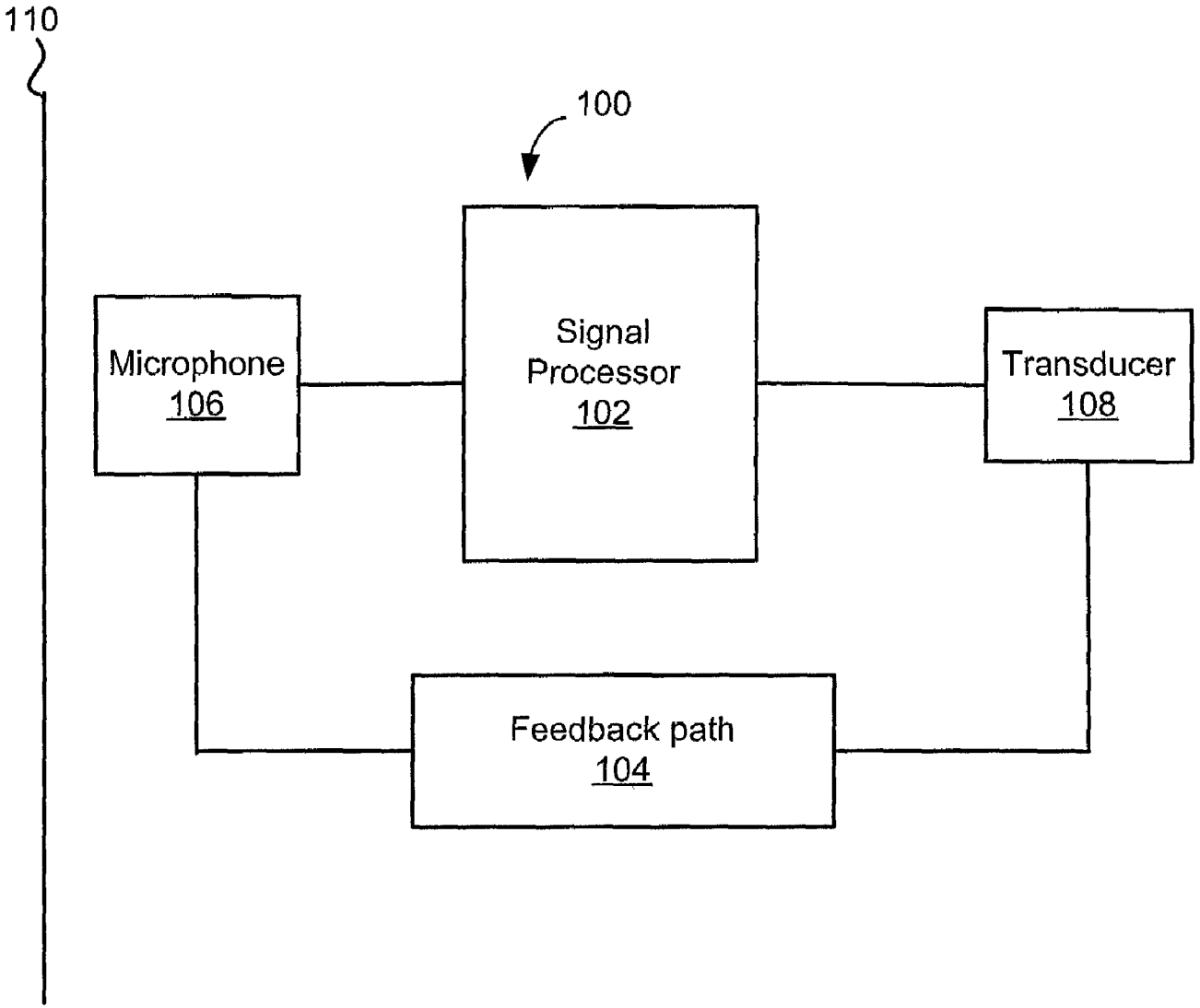
FIG. 1 illustrates one embodiment of a hearing aid configured with a frequency equalization system.

FIG. 1 illustrates one embodiment of a hearing aid 100. The hearing aid 100 includes a signal processor 102, a transducer 108, and a microphone 106. The signal processor 102 is connected to the transducer 108 and the microphone 106, all of which are fully implanted under the skin 110 of a patient. The hearing aid 100 is operational to receive and process acoustic sound in the microphone 106 to generate acoustic frequency responses for the signal processor 102. The signal processor 102 processes the acoustic frequency responses according to programmed speech processing logic and internal values generated from prescriptive parameters for a patient. The processed acoustic frequency responses are provided to the transducer 108, which in turn, causes the transducer 108 to stimulate a component of the auditory system to produce the sensation of hearing for the patient.

In a hearing aid, such as hearing aid 100, it usually cannot be avoided that at least a portion of the output signal from the signal processor 102 is provided as feedback over a feedback path, such as path 104. The feedback path 104 usually includes the bones and/or other parts of the skull, or the eardrum coupled with the air in the ear canal. The feedback over the path 104 is often detectable by the microphone 106, thereby causing the generation of a feedback frequency response by the microphone 106.

While such feedback is generally considered undesirable, the present invention makes use of its existence, at least on a temporary basis, to compensate for another undesirable characteristic of implanted hearing aids. That is, changes in the acoustic frequency response, over time, generated by the microphone 106. These changes being caused by the changing characteristics, over time, of the tissue surrounding the microphone 106.

In this regard, the microphone 106 could be any implantable device(s) that is operational to transcutaneously receive and process acoustic sound to generate frequency responses for the signal processor 102. In one example of this embodiment, the microphone 106 could be a conventional omni-directional microphone. The acoustic sound could be that which the microphone 106 is intended to detect under normal operation or acoustic sound generated over the feedback path 104. In the context of the present invention, the term "acoustic frequency response(s)" refer to the frequency response of the microphone generated in response to ambient acoustic sound detected by the microphone. The term "feedback frequency response(s)" refer to the frequency response of the microphone generated in response to acoustic sound detected over the feedback path 104. Similarly, the term "calibration frequency response(s)" refer to the frequency response of the microphone generated in response to a baseline or known frequency response. Those skilled in the art will appreciate, however, that while the terms distinguish between different frequency responses of the microphone 106 to illustrate the principles of the present invention, they are all representative of the frequency response of the microphone to an acoustic input.

The signal processor 102 could be any device or group of devices configured to periodically conduct a test on the frequency response of the microphone 106 to determine if the frequency response has changed. In that regard, the signal processor 102 generates and provides a test signal to the transducer 108 that is detectable by the microphone 106 over the feedback over path 104. The signal processor 102 also processes a feedback frequency response from the microphone 106 to generate at least a single iteration or data set for an equalization matrix. As will become apparent from the following description, the equalization matrix could include several iterations with the current or last generated data set being used until another test is performed. The signal processor 102 uses the equalization matrix to determine if the frequency response has changed, and if so, to compensate for the changes. The equalization matrix could be any data set that includes test parameters indicative of the difference between the prior frequency response of the microphone 106 and the current frequency response of the microphone 106. It should be noted, however, that the equalization matrix may be a stand alone module or may be incorporated into the frequency shaping tables of the signal processor 102.

The transducer 108 could be any device that is configured to stimulate a component of the auditory system responsive to an input from the signal processor 102. The transducer 108 could be an implanted mechanical, electrical, electro-mechanical, or acoustic transducer that stimulates the auditory system to produce the sensation of sound for a patient.

Figure 2:
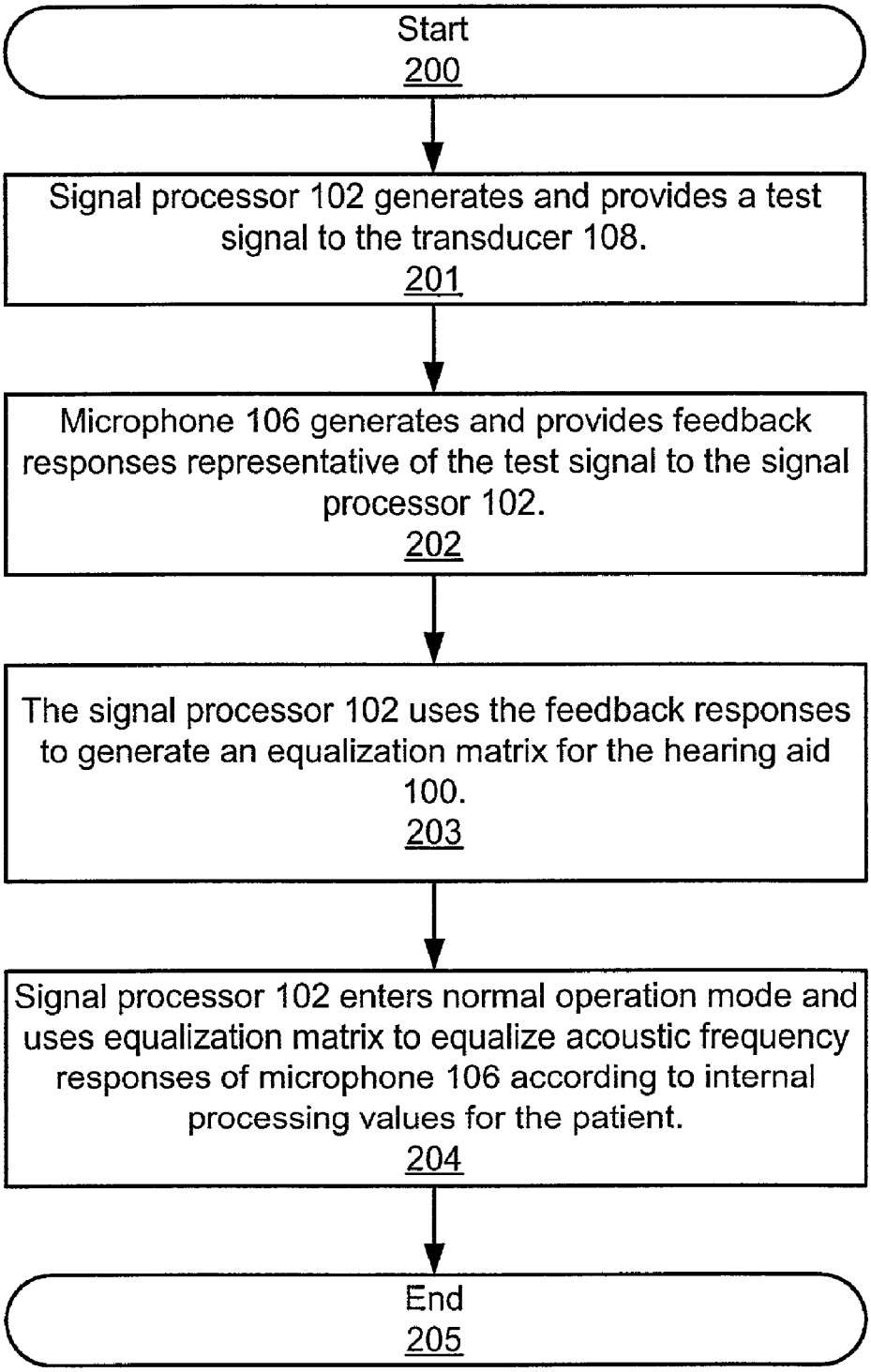
FIG. 2 is a flow chart illustrating an example of the operation of the hearing aid of FIG. 1.

FIG. 2 is a flow chart illustrating one example of the operation of the hearing aid 100. It should be noted that the following operation could be performed at any time following the implant of the hearing aid 100, but is preferably performed at regular intervals at least until it is determined that the tissue surrounding the microphone 106 has reached a steady state. Thereafter, the time between intervals may be increased as a matter of design choice. Some examples of when the operation could be performed include without limitation, on a daily basis initially after the implant (e.g. during the initial healing and bodies response to the implant) and thereafter on a weekly basis as a stabilized state is reached. Alternatively, the operation may be performed each time the hearing aid 100 is turned on or during an event such as recharging of a power source.

On FIG. 2, the operation begins at step 200 whereby the signal processor 102 enters a test mode. At step 201, the signal processor 102 generates and provides a test signal to the transducer 108. The test mode could be any mode whereby the signal processor 102 is operational to detect only the feedback frequency response of the microphone 106 representative of the test signal. The test signal could be any signal that is at least eventually detectable by the microphone 106 over the feedback path 104. For example, the test signal could be generated at a predefined frequency to produce at least one predetermined tone. The at least one tone may be audible or inaudible to the patient as a matter of design choice, so long as the tone is detectable as feedback over the path 104 by the microphone 106. In that regard, the test signal may be in the form of noise or pseudorandom noise or one or more chirps. In a preferred example, the test signal is inaudible to the patient and is swept across a predetermined frequency range to generate a plurality of tones at a plurality of frequencies. In this case, the plurality of tones are sequentially generated beginning with lower frequency tones and ending with higher frequency tones. While it is not necessary that all of the individual test tones be detectable by the microphone 106, the tones should be provided at the different frequencies until the tones are initially detected and thereafter until a representative sampling of the feedback response at different frequencies can be obtained.

At step 202, the microphone 106 generates and provides feedback frequency responses representative of the test signal to the signal processor 102. At step 203, the signal processor 102 uses the feedback frequency responses to generate an equalization matrix for the hearing aid 100. The equalization matrix could be any data set that includes parameters for compensating or equalizing the frequency response of the microphone 106 to negate the effects of changes caused by the tissue surrounding the microphone 106. As will become apparent from the following description, various methods of generating the equalization matrix from the feedback frequency response could be used as a matter of design choice.

At step 204, the signal processor 102 enters a normal operation mode and thereafter uses the equalization matrix to equalize acoustic frequency responses from the microphone 106 according to the internal processing values for the patient. The equalization of the acoustic frequency responses could be any processing step whereby the signal processor 102 accounts for changes, over time, in the frequency response of the microphone. For example, the signal processor 102 may increase or decrease the gain at individual frequencies according to the internal values for the patient to achieve a desired auditory result. At step 205, the operation ends.

FIG. 3 illustrates an example of an equalization matrix, namely equalization matrix 300. The equalization matrix 300 includes a plurality of delta frequencies computed at a plurality of frequencies during a plurality of test sessions. The test sessions, e.g. sessions 1–Nth, are representative of one iteration of the operation described in FIG. 2. In that regard, during each session, e.g. session (1), a plurality of delta frequencies as exemplified by $\Delta F1_1$–$\Delta FNth_1$ are generated by the signal processor 102 at a plurality of frequencies. These delta frequencies are thereafter utilized by the signal processor 102 until another test session, e.g. session (2), is performed by the signal processor 102 and a another set of delta frequencies, e.g. $\Delta F1_2$–$\Delta FNth_2$ are generated.

In a first embodiment of the equalization matrix 300, the delta frequencies, such as the frequency $\Delta F1_1$ of the first test session, could be the computed difference between a test tone generated at a pre-determined frequency, e.g. 250 Hz, and the frequency of the feedback frequency response representing the test tone as provided to the signal processor 102 by the microphone 106. Similarly, the frequency $\Delta F2_1$ would be the difference between a test tone generated at a second pre-determined frequency, e.g. 400 Hz, and the frequency of the feedback frequency response representing the test tone as provided to the signal processor 102 by the microphone 106. In this manner a plurality of delta frequencies $\Delta F1_1$–$\Delta FNth_1$ are computed at the different frequencies, which are indicative of changes in the frequency response of the microphone 106 at those frequencies, e.g. by comparison to a known or previous frequency response at the same frequency.

In a second embodiment of the equalization matrix 300, the delta frequencies such as the frequencies $\Delta F1_1$ of the first test session, could be the difference between an average of the feedback frequency response for a plurality of test tones generated at the pre-determined frequency, e.g. 250 Hz, and a calibration frequency response for a tone at the 250 Hz frequency. Similarly, the frequency $\Delta F2_1$ would be the difference between an average of the feedback frequency response for a plurality of test tones generated at the predetermined frequency, e.g. 400 Hz, and a calibration frequency response for a tone at the 400 Hz frequency. The calibration frequency responses for the various frequencies could be generated by the method of FIG. 2, during tuning and testing of the hearing aid 100 immediately following the implant procedure. Thereafter, the method of FIG. 2 could be used to generate the equalization matrix 300 using the calibration matrix generated during the initial tuning and testing of the hearing aid 100.

Advantageously, using the average of a plurality of test tones generated at a pre-determined frequency prevents an inaccurate frequency response due to a temporary abnormal condition from skewing the delta frequencies. For example, if the test session is performed while a patient is approaching a sound reflecting article, a significant change in the feedback frequency response that is not indicative of the normal response could be produced resulting in a skewed result. If the condition is removed during the test session, the average over the plurality of test tones results in the generation of a substantially accurate delta frequency. As will become apparent from the following description, further methods may be used to accommodate the case where the abnormal condition is not of a temporary nature, but rather, persists throughout the course of the test session.

In a third embodiment of the equalization matrix 300, the delta frequencies such as the frequencies $\Delta F1_1$ of the first test session, could be the difference between a single test tone or the average of a plurality of test tones generated at the pre-determined frequency, e.g. 250 Hz, and a baseline frequency response at the 250 Hz frequency for the microphone 106. Similarly, the frequency $\Delta F2_1$ is the difference between a single test tone or the average of a plurality of test tones generated at the pre-determined frequency, e.g. 400 Hz, and a baseline frequency response at the 400 Hz frequency for the microphone 106. The baseline frequency response(s) could be generated by the hearing aid manufacturer, and be included in the processing logic of signal processor 102.

In a fourth embodiment of the equalization matrix 300, the delta frequencies of the first test session $\Delta F1_1$–$\Delta FNth_1$ could be used to generate the delta frequencies for the remaining sessions. In this case, the delta frequencies $\Delta F1_1$–$\Delta FNth_1$ would be generated by the signal processor 102 during a setup protocol implemented when the hearing aid 100 is implanted, and thus represent a baseline from which to generate additional delta frequencies, e.g. $\Delta F1_2$. Thus, $\Delta F1_2$ of the second test session would be the difference between the frequency response of a test tone generated at 250 Hz and $\Delta F1_1$, which is the baseline frequency response at 250 Hz for the microphone 106. Similarly, $\Delta F2_2$ would be the difference between a test tone generated at 400 Hz and $\Delta F2_1$, which is the baseline frequency response at 400 Hz for the microphone 106.

Figure 4:
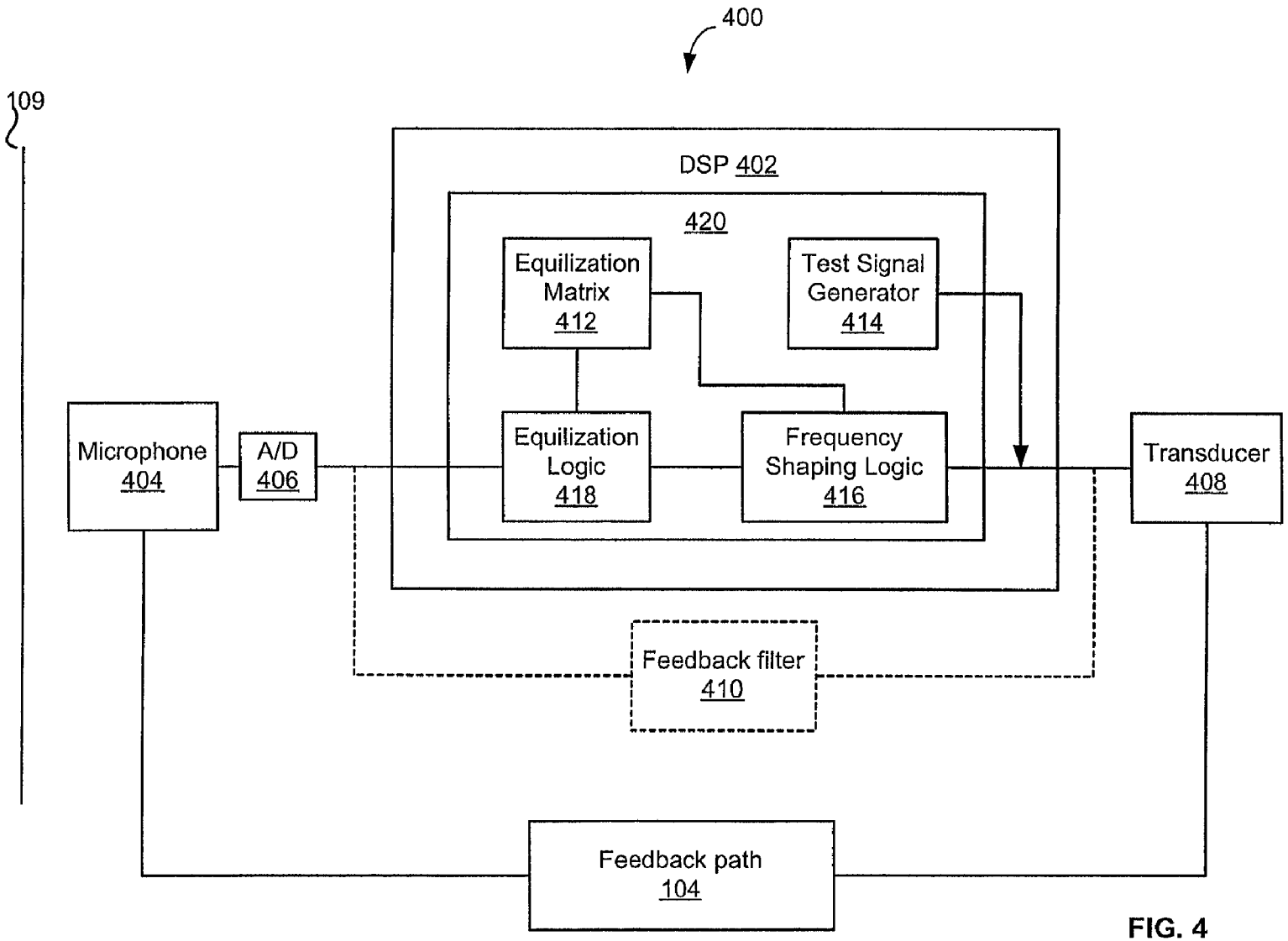
FIG. 4 illustrates another embodiment of a hearing aid configured with a frequency equalization system.

FIG. 4 illustrates another embodiment of a hearing aid, namely hearing aid 400. Those skilled in the art will appreciate how this embodiment could be combined with the other embodiments disclosed herein to form numerous additional embodiments in accordance with the principles of the present invention.

The hearing aid 400 includes a microphone 404, an analog to digital (A/D) converter 406, a digital signal processor 402, and a transducer 408. The DSP 402 includes equalization logic 418, frequency shaping logic 416, and a test signal generator 414 collectively referred to herein as frequency equalization system 420.

The A/D converter 406 is operational to convert analog frequency responses from the microphone 404 to a digital signal for the DSP 402. The feedback path 104 is also included on FIG. 4 to illustrate that at least a portion of the output signal from the DSP 402 is provided back to the microphone 408 as feedback. Also, shown on FIG. 4 is a feedback filter that may be present on some hearing aids as a matter of design choice, and therefore is indicated by the dashed lines.

The test signal generator 414 generates and provides the test signal to the transducer 404. As with the above-described embodiment, the test signal may be a signal that causes the generation of a single test tone or plurality of test tones generated at different frequencies by the transducer 408. The test tones, however, are preferably generated in a frequency domain that does not cause un-damped oscillation in the hearing aid 400. Those skilled in the art will appreciate that this frequency range is a function of the hearing aid type and system design, but is easily determinable from the phase, e.g. a feedback phase of zero (0) degrees is required for oscillation.

The transducer 404 may be an electromechanical transducer having a vibratory member connected to the ossicular chain, e.g. the incus bone. In this type of hearing aid, mechanical energy from the transducer 404, resulting from the test tones is not only provided to the cochlea 410 via the ossicular chain, but is also transmitted to the tympanic membrane. In this regard, the tympanic membrane 414, functions as a speaker diaphragm, converting the mechanical energy to an acoustic feedback signal that is provided over the feedback path 104. Alternatively, the transducer 404 could be any type of transducer that stimulates a component of the auditory system.

The microphone 404 is preferably an omni-direction microphone that detects the acoustic feedback signal and generates a feedback frequency response that is provided to the equalization logic 418 of the DSP 402. Responsive to receiving the feedback frequency response, the equalization logic 418 determines the time behavior and the frequency behavior of the feedback frequency response from the microphone 404 to generate the equalization matrix 300. In this regard, the equalization logic 418 may also compare the feedback frequency response to an upper and a lower threshold frequency response. The upper and lower thresholds define the range of expected feedback frequency responses from the microphone 404. If the feedback frequency response is outside the upper and lower threshold response, the equalization logic 418 could continue to use the previous feedback frequency response, thereby preventing an abnormal condition from skewing the computed parameters for equalization matrix 300. For example, if the patient is proximate a sound reflecting article or sound absorbing article, the microphone 404 may generate an abnormal feedback frequency response leading to skewed parameters in the equalization matrix 300 if utilized. If the condition persists during the test session, the equalization logic 418 does not update the equalization matrix and the previously determined parameters or default parameters are utilized.

The frequency shaping logic 416 uses the equalization matrix 412 to equalize the frequency response of the microphone 404 to compensate for changes in the frequency response caused by tissue growth. The frequency shaping logic 416 includes the processing steps such as amplification, frequency shaping, compression, etc according to the design of the hearing aid 400. The frequency shaping logic 416 also includes the particular internal values used in the processing generated from prescriptive parameters determined by an audiologist. Thus, depending on the results realized from the equalization matrix, the frequency shaping logic 416 may perform additional frequency shaping such as increasing or decreasing the gain at frequencies affected by the tissue growth.

During a test session, the DSP 402 operates in a limited capacity or test mode to only look at the spectral components of the test signal. Other frequency ranges are temporarily disregarded while the test signal (including the test tone(s)) is generated and analyzed to create the equalization matrix 300. Additionally, in hearing aids including the feedback filter 410, the limited capacity operation would include temporarily disabling or bypassing the filter 410 to ensure that feedback representative of the test single is detectable by the microphone 404. Following the performance of a test session, the DSP 402 resumes normal operation and the frequency shaping logic 416 processes acoustic frequency responses from the microphone 404 using the equalization matrix 300 and programmed processing steps and parameters to equalize the acoustic frequency responses according to changes caused by tissue growth.

The above-described elements can be comprised of instructions that are stored on storage media. The instructions can be retrieved and executed by a processing system. Some examples of instructions are software, program code, and firmware. Some examples of storage media are memory devices, tape, disks, integrated circuits, and servers. The instructions are operational when executed by the processing system to direct the processing system to operate in accord with the invention. The term "processing system" refers to a single processing device or a group of inter-operational processing devices. Some examples of processing systems are integrated circuits and logic circuitry. Those skilled in the art are familiar with instructions, processing systems, and storage media.

Those skilled in the art will appreciate variations of the above-described embodiments that fall within the scope of the invention. As a result, the invention is not limited to the specific examples and illustrations discussed above, but only by the following claims and their equivalents.

We claim:

1. A hearing aid, comprising:

a transducer implantable within a patient to stimulate a component of an auditory system;

an implantable microphone to process acoustic sounds and generate frequency responses representative of the acoustic sounds; and a signal processor to process at least one feedback frequency response from the microphone to:

identify chances between the least one feedback frequency response and a previously determined frequency response;

generate at least one test parameter based on said changes; and use the at least one test parameter to change acoustic frequency responses of the microphone generated in response to acoustic sounds; and wherein the feedback frequency response is generated by the microphone in response to an acoustic feedback sound generated in conjunction with actuation of said transducer in response to at least one test signal.

2. The hearing aid of claim 1 comprising:

a test signal generator to generate and provide the at least one test signal to the transducer, wherein the at least one test signal causes the transducer to stimulate the component of the auditory system and generate the acoustic feedback sound.

3. The hearing aid of claim 2 wherein the signal processor is configured to generate and provide the at least one test signal to the transducer.

4. The hearing aid of claim 3 wherein the at least one test signal is provided at a predetermined frequency to generate the acoustic feedback sound at a predetermined tone.

5. The hearing aid of claim 3 wherein the at least one test signal is swept across a predetermined frequency range to generate the acoustic feedback sound at a plurality of predetermined tones.

6. The hearing aid of claim 3 wherein the at least one test signal comprises:

one of noise and pseudorandom noise.

7. The hearing aid of claim 3 wherein the at least one test signal comprises:

at least one chirp.

8. The hearing aid of claim 1 wherein the signal processor is configured to use the at least one test parameter to generate drive signals for the transducer that compensate for the changes between the acoustic frequency responses of the microphone.

9. The hearing aid system of claim 8 wherein the at least one test parameter comprises:

at least one delta frequency representative of a difference between the at least one feedback frequency response and a calibration frequency response.

10. The hearing aid system of claim 9 wherein the at least one test parameter comprises:

at least one delta frequency representative of a difference between an average of a plurality of feedback frequency responses and the calibration frequency response.

11. The hearing aid system of claim 9 wherein the signal processor is configured to use the at least one delta frequency to generate drive signals for the transducer that compensate for the changing characteristics of the frequency responses according to prescriptive parameters for the patient.

12. The hearing aid system of claim 9 wherein the signal processor includes an upper and lower threshold frequency response, and if the feedback frequency response is within the upper and lower threshold frequency response, the signal processor processes the feedback frequency response to generate the at least one delta frequency, and if the feedback frequency response is outside the upper and lower threshold frequency response, the signal processor continues to use a previous feedback frequency response.

13. The hearing aid system of claim 1 wherein the signal processor is a digital signal processor.

14. In a hearing aid, a method of compensating for changing characteristics of frequency responses generated by an implantable microphone in response to an acoustic input, the method comprising:

conducting a test session to determine a current frequency response of the microphone;

comparing the current frequency response to a previously determined frequency response of the microphone to identify differences in the frequency responses;

generating at least one test parameter representative of the differences in the frequency responses of the microphone; and using the at least one test parameter to generate drive signals for a transducer that compensate for the differences in the frequency responses of the microphone.

15. The method of claim 14 wherein the step of conducting the test session comprises the steps of:

generating and providing a test signal to a transducer;

driving the transducer with the test signal to generate acoustic feedback;

detecting the acoustic feedback in the microphone;

generating the current feedback frequency response in the microphone; and comparing the current feedback frequency response with the test signal to determine the at least one test parameter.

16. The method of claim 15 wherein generating and providing the test signal comprises:

generating and providing the test signal at a predetermined frequency to generate the acoustic feedback sound at a predetermined tone.

17. The method of claim 15 wherein the step of generating and providing the test signal comprises:

generating and providing the test signal at a plurality of predetermined frequencies to generate the acoustic feedback sound at a plurality of predetermined tones.

18. The method of claim 14 further comprising:

computing at least one delta frequency representative of a difference between the current feedback frequency response and the previously determined frequency response.

19. The method of claim 14 further comprising:

computing at least one delta frequency representative of a difference between an average of a plurality of feedback frequency responses and the response.

20. The method of claim 18 further comprising:

using the delta frequency response to generate drive signals for the transducer that compensate for the changes in the frequency responses of the microphone, wherein using the delta frequency comprises processing acoustic frequency responses from the microphone using the at least one delta frequency.

21. The method of claim 18 comprising:

comparing the current feedback frequency response to an upper and lower threshold frequency response, and if the current feedback frequency response is within the upper and lower threshold frequency response, using the current feedback frequency response to generate the at least one delta frequency, and if the current feedback frequency response is outside the upper and lower threshold frequency response, using a previous feedback frequency response.

22. A hearing aid comprising:

a transducer implantable within a patient to stimulate a component of an auditory system;

a microphone to process acoustic sounds and generate frequency responses; and a signal processor to process at least one feedback frequency response from the microphone, compare the at least one feedback frequency response with a reference frequency response to generate drive signals for the transducer that compensate for changed characteristics of the microphone frequency responses, wherein the at least one feedback frequency response is generated by the microphone in response to an acoustic feedback sound generated in conjunction with actuation of said transducer in response to at least one test signal.

23. The hearing aid of claim 22 comprising:

a test signal generator to generate and provide the at least one test signal to the transducer that causes the transducer to stimulate the component of the auditory system and generate the acoustic feedback sound.

24. The hearing aid of claim 22 wherein the signal processor is configured to generate and provide the at least one test signal to the transducer that causes the transducer to stimulate the component of the auditory system and generate the acoustic feedback sound.

25. The hearing aid of claim 23 wherein the at least one test signal is provided at a predetermined frequency to generate the acoustic feedback sound at a predetermined tone.

26. The hearing aid of claim 23 wherein the at least one test signal is swept across a predetermined frequency range to generate the acoustic feedback sound at a plurality of predetermined tones.

27. The hearing aid of claim 23 wherein the at least one test signal is one of noise and pseudorandom noise.

28. The hearing aid of claim 23 wherein the at least one test signal is a chirp.

29. The hearing aid system of claim 22 wherein the processor is operative to determine at least one delta frequency representative of a difference between the feedback frequency response and a calibration frequency response.

30. The hearing aid system of claim 29 wherein the processor is operative to determine at least one delta frequency representative of a difference between an average of a plurality of feedback frequency responses and the calibration frequency response.

31. The hearing aid system of claim 29 wherein the signal processor is configured to use the at least one delta frequency to generate the drive signals for the transducer that compensate for the changing characteristics of the frequency responses according to prescriptive parameters for the patient.

32. The hearing aid system of claim 29 wherein the signal processor includes an upper and lower threshold frequency response, and if the feedback frequency response is within the upper and lower threshold frequency response, the signal processor processes the feedback frequency response to generate the at least one delta frequency, and if the feedback frequency response is outside the upper and lower threshold frequency response, the signal processor continues to use a previous feedback frequency response.

33. The hearing aid system of claim 22 wherein the signal processor is a digital signal processor.

* * * * *

UNITED STATES PATENT AND TRADEMARK OFFICE

CERTIFICATE OF CORRECTION

PATENT NO. : 7,197,152 B2
APPLICATION NO. : 10/082988
DATED : March 27, 2007
INVENTOR(S) : Miller et al.

It is certified that error appears in the above-identified patent and that said Letters Patent is hereby corrected as shown below:

Column 10
Line 58, delete “chances” and insert therefore --changes--;
Line 58, after “the”, insert --at--.

Column 12
Line 39, Claim 10, after “the”, insert --previously determined frequency--.

Signed and Sealed this

Fifteenth Day of May, 2007

JON W. DUDAS
*Director of the United States Patent and Trademark Office*